US007955706B1

(12) United States Patent
Withers et al.

(10) Patent No.: US 7,955,706 B1
(45) Date of Patent: Jun. 7, 2011

(54) COMPOSITE ARMOR TILE BASED ON A CONTINUOUSLY GRADED CERAMIC-METAL COMPOSITION AND MANUFACTURE THEREOF

(75) Inventors: James C. Withers, Tucson, AZ (US); Roger S. Storm, Tucson, AZ (US); Vladimir Shapovalov, Albuquerque, NM (US); Raouf Loutfy, Tucson, AZ (US)

(73) Assignee: Materials & Electrochemical Research Corp., Tucson, AZ (US)

( * ) Notice: Subject to any disclaimer, the term of this patent is extended or adjusted under 35 U.S.C. 154(b) by 987 days.

(21) Appl. No.: 11/770,453

(22) Filed: Jun. 28, 2007

Related U.S. Application Data

(62) Division of application No. 11/770,172, filed on Jun. 28, 2007.

(60) Provisional application No. 60/806,442, filed on Jun. 30, 2006.

(51) Int. Cl.
*C23C 4/10* (2006.01)

(52) U.S. Cl. ..... 428/469; 428/698; 428/539.5; 428/547; 428/610; 428/632; 428/323; 428/212; 428/472; 428/310.5; 89/36.02

(58) Field of Classification Search ..... None
See application file for complete search history.

(56) References Cited

U.S. PATENT DOCUMENTS

| | | | | |
|---|---|---|---|---|
| 3,633,520 | A | 1/1972 | Stiglich, Jr. | 109/82 |
| 3,802,850 | A | 4/1974 | Clougherty | 29/182.2 |
| 3,804,034 | A | 4/1974 | Stiglich, Jr. | 109/80 |
| 4,778,869 | A | 10/1988 | Schirmann et al. | 526/304 |
| 4,988,645 | A | 1/1991 | Holt et al. | 501/91 |
| 5,443,917 | A | 8/1995 | Tarry | 428/545 |
| 5,523,374 | A | 6/1996 | Bard et al. | 528/26 |
| 5,735,332 | A | 4/1998 | Ritland et al. | 164/98 |
| 6,405,095 | B1 * | 6/2002 | Jang et al. | 700/118 |
| 6,635,357 | B2 * | 10/2003 | Moxson et al. | 428/548 |
| 6,679,157 | B2 | 1/2004 | Chu et al. | 89/36.02 |
| 6,895,851 | B1 | 5/2005 | Adams et al. | 89/36.02 |
| 6,940,037 | B1 | 9/2005 | Kovacevik et al. | |
| 6,955,112 | B1 | 10/2005 | Adams et al. | 89/36.02 |
| 7,501,081 | B2 * | 3/2009 | Chandran | 252/520.22 |
| 2006/0185473 | A1 | 8/2006 | Withers et al. | 75/10.13 |
| 2008/0000881 | A1 * | 1/2008 | Storm et al. | 219/121.47 |

OTHER PUBLICATIONS

U.S. Official Action issued in U.S. Appl. No. 11/770,172, dated Apr. 13, 2010.

Panda, et al., Titanium-Titanium Boride (Ti-TiB) Functionally Graded Materials through Reaction Sintering: Synthesis, Microstructure, and Properties, Metallurgical and Materials Transaction A, vol. 34A, Sep. 2003, pp. 1993-2003.

Sahay et al., "Evolution of microstructure and phases in in situ processed Ti-TiB composites containing high volume fractions of TiB whiskers", Journal of Materials Research, J. Mater. Res., vol. 14, No. 11, Nov. 1999, pp. 4214-4223.

(Continued)

*Primary Examiner* — Timothy M Speer
*Assistant Examiner* — Vera Katz
(74) *Attorney, Agent, or Firm* — Hayes Soloway P.C.

(57) ABSTRACT

A cermet armor material for highly effective ballistic performance which is comprised of a layer of base metal in which is deposited a layer or layers of ceramic and a compatible metal such that the deposited metal in combination with the base metal forms a continuous matrix around the ceramic particles. The body has a structure which is continuously graded from a highest ceramic content at the outer surface (strike face) decreasing to zero within the base substrate, and contained no abrupt interfaces.

17 Claims, 7 Drawing Sheets

OTHER PUBLICATIONS

W. Lucas, Tig and Plasma Welding: Process Techniques, Recommended Practices and Applications, published by Woodhead Publishing, 1990, ISBN 1855730057, 9781855730052, available at http://books.google.com/books?id—OopTt5mRPJUC&pg=PA28&dq=weld+argon+hydrogen+%2Btitanium&source=web&ots=MWFZ53b_Ma&sig=qtbOY7FJ8QcVKdKfOu67R8Nv4Rg&h1=en&sa=X&oi=book=result&resnum=7&ct=result (last visited Nov. 9, 2008), entire document, esp. p. 28.

U.S. Official Action issued in U.S. Appl. No. 11/770,172, dated Jul. 22, 2010, (20 pgs).

* cited by examiner

COMPOSITE ARMOR TILE BASED ON A CONTINUOUSLY GRADED CERAMIC-METAL COMPOSITION AND MANUFACTURE THEREOF

CROSS REFERENCE TO RELATED APPLICATION

This application claims priority from U.S. Provisional Patent Application Ser. No. 60/806,442, filed Jun. 30, 2006, and is a divisional of U.S. patent application Ser. No. 11/770,172, filed Jun. 28, 2007.

STATEMENT REGARDING FEDERALLY SPONSORED RESEARCH OF DEVELOPMENT

This invention was partially made with Government support under contract number W15QKN-04-C-1028 awarded by the United States Army. The Government may have certain rights in the invention.

BACKGROUND OF THE INVENTION

This invention relates to a composite armor component of a metal and ceramic and its method of manufacture.

DESCRIPTION OF THE PRIOR ART

Armor systems to provide ballistic protection for both personal and vehicular application encompass a wide range of designs and materials to respond to varying threats. Steel armor is commonly used and can provide ballistic protection against a variety of threats. However the high mass density of steel results in a weight for such armor which is considered excessive for many applications. The measure commonly used to classify the weight characteristics of an armor system is "areal density". Areal density is the weight of 1 $ft^2$ of armor of a particular thickness, e.g. 1". In reference to a specific threat, the areal density is that which is required to stop a specific threat at a specific velocity. For that reason, steel is used, e.g., for applications where weight is not a major consideration such as heavy vehicles. Importantly, steel armor provides the capability to absorb multiple ballistic events without fracturing thus providing multi-hit capability. Steel is also the least expensive metal armor system.

Ceramic armor is much lighter in weight than steel and can provide protection for a single shot at a much lower areal density than that required for steel. Because of the high hardness of ceramics, they can provide greater protection against armor piercing projectiles. However, ceramics are also very brittle and can fracture after a single ballistic event. Ceramics thus do not provide multi-hit capability. Ceramics are also very expensive, due in part to their very high processing costs.

Lighter weight metals such as titanium alloys have been considered for ballistic protection. However a greater thickness of these lighter metals is required to achieve the same level of stopping power as steel. This can greatly diminish the areal density difference required to produce equivalent ballistic performance.

A class of materials consisting of ceramic particulates dispersed in a metal called metal matrix composites or cermets also have been considered for armor applications but have not found widespread application. In general, ballistic performance of cermets requires a high loading of ceramic filler in the metal matrix. This results in the cermets becoming brittle, causing fracture after a ballistic event and limiting multi-hit capability. Attempts are described in the literature, including the patent literature, to overcome this brittle fracture by forming a cermet with a graded structure wherein the ratio of ceramic to metal decreases as the distance from the front face (or strike face) increases. However, these attempts describe producing a series of discrete layers with varying ratios of ceramic to metal content. For example, an armor system is described that contains a front face that is 100% ceramic, a back face that is 100% metal, and a discrete intermediate layer or layers of differing ceramic/metal content. Since these methods do not produce a continuous gradation from the front surface to the back surface, this approach would not be expected to provide multi-hit capability. The energy from the ballistic impact would be expected to shatter the ceramic strike face and the cermet layer(s). In addition, the manufacturing methods for producing high performance metal matrix composites, e.g. hot pressing, powder metallurgy, and squeeze casting, are more expensive than conventional metal manufacturing processes.

There are several US patents describing an armor system which is made of a ceramic-metal (cermet) material. Stiglich in U.S. Pat. No. 3,633,520 describes a gradient armor product based on aluminum oxide ($Al_2O_3$) as the ceramic and molybdenum as the metal. The armor has a high hardness impact face which is 100% $Al_2O_3$ and a rear face which contains 0.5-50% by volume of Mo. There is also an intermediate ceramic-metal layer which is continuously graded within the layer, but not to the outer layers. Also, in the Stiglich teaching, the aluminum oxide ceramic is the continuous matrix, and the metal, Mo, is particulate, whereas in the instant invention, the metal is the continuous matrix, with particulate ceramic dispersed within the matrix. However, Mo has a 30% higher density than steel which makes it unlikely to be used as armor. U.S. Pat. No. 3,804,034, also by Stiglich, describes a gradient armor containing discrete layers which include a projectile impact face, a rear face which is described by the author as predominantly metallic titanium, and an intermediate layer containing a ceramic alloy of TiB and TiC, and particulate titanium. As with the earlier patent by Stiglich, the ceramic comprises the continuous matrix, with particulate titanium dispersed in the continuous ceramic matrix.

The armor described by Tarry in U.S. Pat. No. 5,443,917 is a ceramic body composed predominantly of TiN and MN. It also describes a structure wherein the ceramic body has <5% (wt) of Al, Fe, Ni, Co, Mo, or mixtures thereof. These compositions are substantially all ceramic and thus would not be expected to provide multi-hit capability.

In U.S. Pat. No. 6,679,157, Chu et al describe an armor system containing discrete layers to provide gradation. Each of the layers has a different volume fraction of ceramic particles in a metal matrix. These layers are produced by a thermal spray deposition process, namely plasma spraying. The structure contains the following layers: a substrate; a metal matrix composite (cermet) layer; and a ceramic impact layer. The cermet layer is made up of multiple discrete cermet layers with varying ceramic to metal ratios. Plasma spraying uses a plasma jet to heat the particles, and gas flow accelerates the particles and deposits them on a target. The metal particles are heated to near or slightly above the melting point of the metal, but when they impact the substrate they have cooled to below their melting point, splatting onto the substrate forming a somewhat porous material. Typically the ceramic particles mixed with the metal in plasma spraying do not reach their melting point. This process results in considerable porosity in the deposited layers, which is detrimental to ballistic performance. Chu et al also utilizes a ceramic impact layer as part of the armor system which is affixed to the graded cermet layers. A preferred example is a pure aluminum oxide ceramic tile which is affixed to the cermet with an adhesive. Alternatively the aluminum oxide can be deposited on the graded metal matrix by spraying. Since the melting point of aluminum oxide, and most ceramics, is considerably above its decomposition temperature, these sprayed layers would be self bonded and very porous, resulting in a significant deterioration of ballistic performance.

Adams et al in U.S. Pat. No. 6,895,851 describe an armor system consisting of discrete layers produced by infiltration with molten metal. These layers contain various reinforcement materials including ceramic particulate. The layers are bound together by encapsulating them within a metal infiltration layer that surrounds them. The process for producing this armor is described by the same authors in U.S. Pat. No. 6,955,112.

There is also prior art describing the formation of graded cermet structures. Lougherty in U.S. Pat. No. 3,802,850 describes a product and process for a graded structure of Ti and $TiB_2$ produced by hot pressing discrete layers with varying Ti/$TiB_2$ ratios. In U.S. Pat. No. 4,778,869 Nino et al describe a process to produce a graded cermet composition by placing reactant powders which are metallic and nonmetallic constitutive elements of the cermet structure in discrete layers of varying reactant content. The graded body is then formed by igniting the mixture to form the desired cermet structure which is known to produce a porous structure. The processing of discrete layers is necessary since, according to Nino et al "it is difficult to regulate the mixture precisely in a continuous way". U.S. Pat. No. 4,988,645 describes a cermet with a continuous ceramic phase which is produced by combustion synthesis which is known to produce a porous structure. U.S. Pat. Nos. 5,523,374 and 5,735,332 both by Ritland et al also describe a graded cermet with a continuous ceramic phase made by sintering the ceramic, which is then infiltrated with molten metal. The gradation is obtained by varying the distribution of porosity in the presintered ceramic.

SUMMARY OF THE INVENTION

The instant invention provides a product and process that will overcome the aforesaid and other limitations of the prior art, resulting in an armor system with exceptional ballistic performance at low areal density with multi-hit capability. More particularly, in accordance with the present invention there is provided a cermet armor material comprised of a layer of base metal into which is deposited a layer or layers of ceramic and a compatible metal such that the deposited metal, in combination with the base metal, forms a continuous matrix around the ceramic particles, and the body has a structure that is continuously graded from the highest ceramic content at the outer surface (strikeface) decreasing to essentially zero ceramic content at the base structure, and containing no abrupt interfaces. In one aspect of the invention, the component has a base metal layer onto which a ceramic powder or mixture of powders are deposited with or without a mixture of the base metal using a high energy beam such as a welding torch to melt the base metal and deposit a continuously graded structure of ceramic into and onto the base metal. The welding torch heats the metal well above its melting point, resulting in a melt bonded deposit with substantially no porosity, and therefore producing maximum ballistic performance. The ceramic particles in the instant invention are introduced by injecting them directly into the molten metal pool of the substrate. Thus, in the instant invention, there is a continual gradation from the front surface to some intermediate depth within the plate or alternatively to the back surface.

BRIEF DESCRIPTION OF THE DRAWINGS

Further features and advantages of the present invention will be seen from the following detailed description taken in conjunction with the following drawings wherein like numerals depict like parts, and wherein.

DETAILED DESCRIPTION OF PREFERRED EMBODIMENTS

Figure 1:
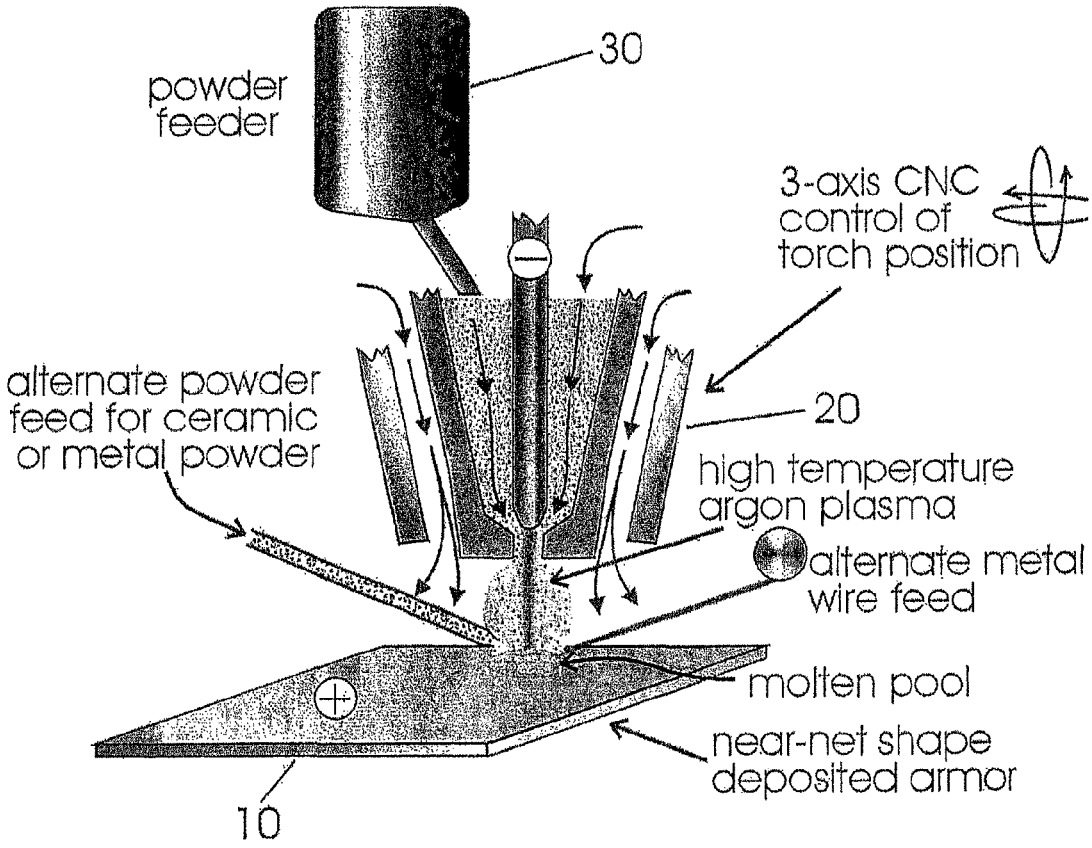
FIG. 1 is a schematic of a 3-dimensional deposition system using a plasma transferred arc welding torch for the deposition of shapes.
Figure 2:
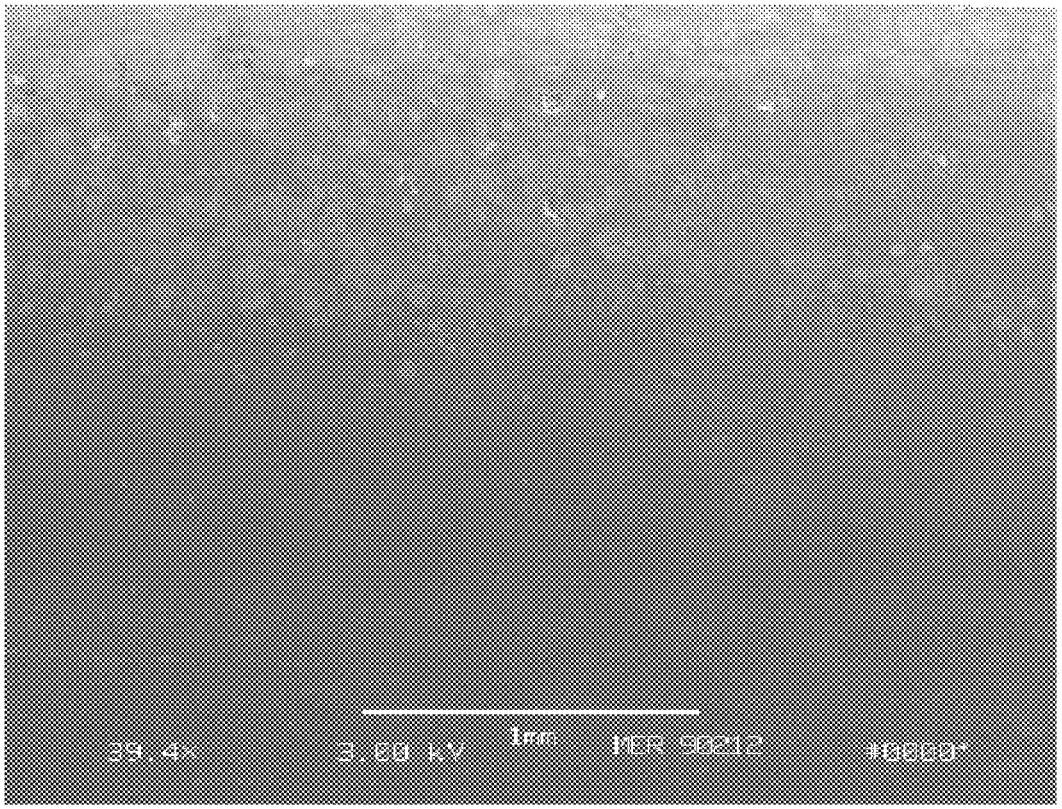
FIG. 2 is a scanning electron micrograph of a tungsten carbide/Ti graded cermet made by deposition of Ti-6-4 and tungsten carbide powders on a Ti-6-4 substrate with a plasma transferred arc welding torch.

FIG. 1 is a schematic of a 3-dimensional deposition system using a plasma transferred arc welding torch for the deposition of the armor tiles using a wire feed for the deposited metal with the ceramic powder injected into the melt pool through the nozzle. Alternatively, the ceramic powder can be injected into the melt pool through a separate feed tube position adjacent to the melt pool. Rather than using a metal feed wire, a mixture of metal powder and ceramic powder can be fed through the nozzle or separate feed tube. Referring to FIG. 1, the process to make this new armor structure starts with a base metal substrate or plate 10. This can be, e.g. a steel, titanium or aluminum alloy. A high energy source such as a welding torch 20 is attached to the movable head of a 2 or 3 axis dimensional controller such as a CNC controller or a robot. Possible high energy sources include a plasma transferred arc (PTA), tungsten inert gas (TIG), or metal inert gas (MIG) welding torches, a laser beam, or an E-beam welding torch, which in the latter case requires operation in a high vacuum for the E-beam operation. Inert gas protection is provided to prevent oxidation of the metal, e.g. by enclosing the torch and surrounding environment in an inert gas chamber, or by utilization of an inert gas trailing shield. The ceramic component 30 of the cermet is then fed to the torch. Optionally, the metal of the cermet can also be fed to the torch. The ceramic is typically in the form of a powder, while the metal can be either a powder or wire. The energy of the torch melts the surface of the base metal as well as the optional metal feed forming a molten pool on the substrate, into which the ceramic powder is injected. Importantly, the torch power is sufficient to melt the base plate to a selected depth so as to provide a continuously graded interface in terms of ceramic/metal content. By controlling the torch travel in the X-Y plane, the molten pool solidifies and a deposition layer is formed into the depth of the plate as well as built up on the metal plate. The cermet armor structure can be applied in a single pass, or multiple cermet layers can be built up for thicker components by raising the Z-axis position of the torch head, ensuring that the torch heat for each new layer also melts the previously deposited layer, thus ensuring the formation of a continuously graded structure. Finally a thin cermet top layer, or strike face, can be deposited with a very high ceramic content, e.g. 50% or more by volume ceramic content, preferably 60% or more, more preferably 70% or more, most preferably 80% or more by volume. Alternatively, the cermet can also be formed with only a ceramic feed, i.e. no metal feed, by melting the surface of the substrate and injecting the ceramic powder into the molten pool. When the armor component of the instant invention is subjected to a ballistic impact, there may be some localized spalling of the high ceramic content layer at the strike face. This spalling may also possibly continue part way into the graded cermet layer. However, since the structure does not contain any abrupt interfaces, at some point the strength of the cermet will exceed the energy of the ballistic projectile and further damage will not occur.

The following examples are to be viewed as illustrative of the present invention and should not be viewed as limiting the scope of the invention as defined by the appended claims Example 1

Figure 3:
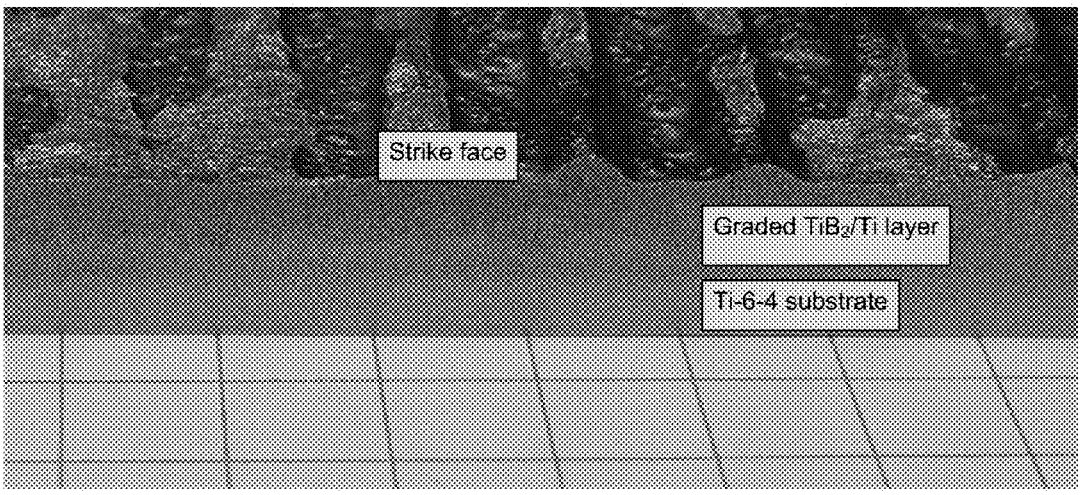
FIG. 3 is a micrograph of the Ti/$TiB_2$ tile described in Example 3, showing a continuous metal matrix, and a continual functional gradation of the $TiB_2$/Ti gradation.
Figure 4:
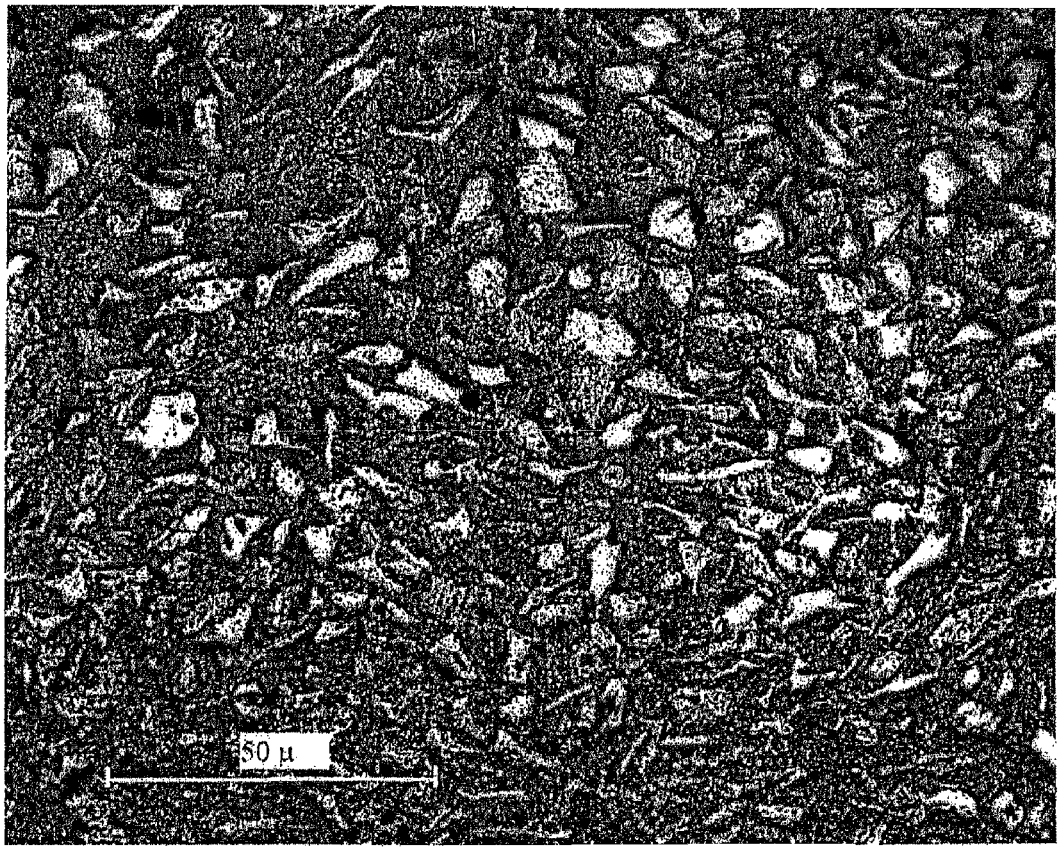
FIG. 4 is a micrograph of a region of the $TiB_2$/Ti-6-4 cermet armor shown in FIG. 3 with a high $TiB_2$ content.
Figure 5:
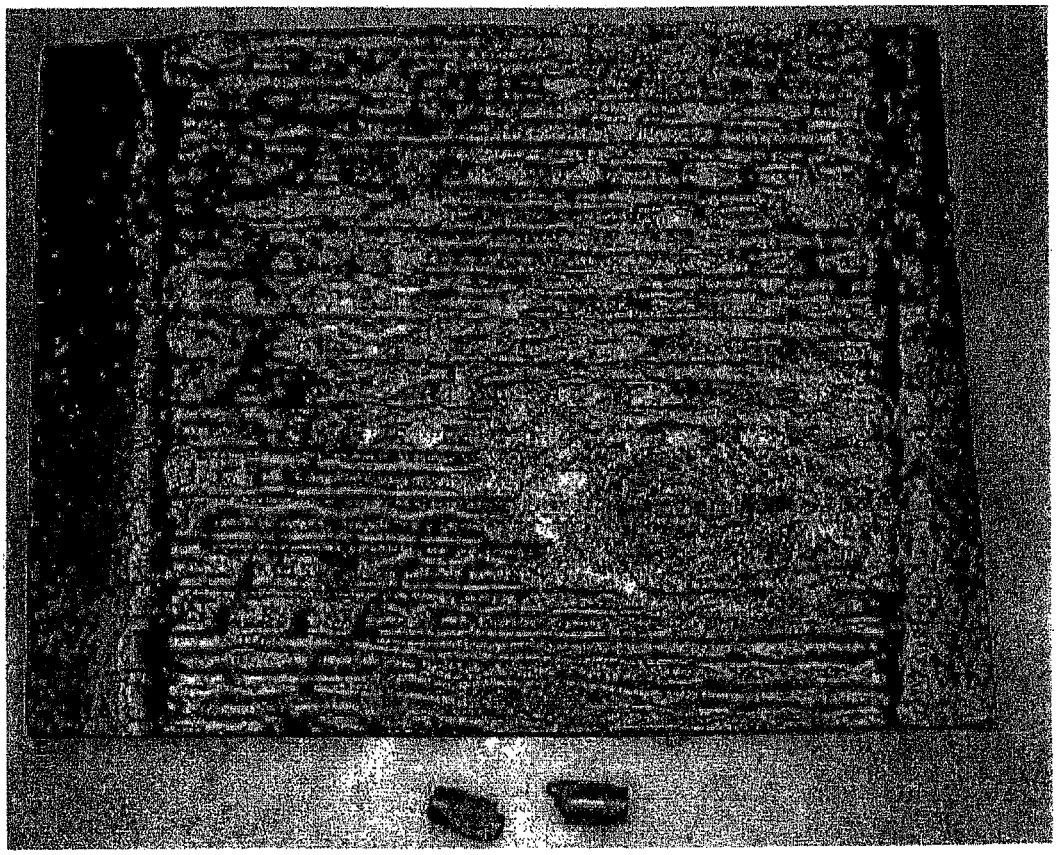
FIG. 5 is a picture of the armor tile of $TiB_2$/Ti-6-4 cermet shown in FIG. 3 after ballistic testing with AP30 at 2750 ft/sec showing multi hit capability.

A commercial plate of Ti-6-4 (Ti-6A1-4V) was used as the substrate to deposit a $TiB_2$/Ti cermet layer using a plasma transferred arc welding torch in an inert gas chamber. The deposit was made in a single pass. The average $TiB_2$ content in the cermet layer was ~70% (vol). The maximum concentration was at the front or strike face, and the lowest concentration was at a depth that was approximately one half of the original Ti-6-4 substrate used for the deposition. The micrograph in FIG. 3 shows that the deposited cermet layer penetrates into the original substrate, producing a continual gradation. The micrograph in FIG. 4 shows the microstructure of a layer with high $TiB_2$ content. Such a microstructure as illustrated in FIGS. 3 and 4 can absorb the energy from a projectile without fracture and the high $TiB_2$ content can defeat the projectile. This is illustrated in FIG. 5 which shows the $TiB_2$/Ti tile from this example after ballistic testing with AP30 at a velocity of 2750 ft/sec.

Example 2

Example 1 was repeated except that the application of $TiB_2$ and Ti was applied under what is termed a trailing shield instead of an inert atmosphere chamber. The trailing shield was flooded with argon to prevent oxidation of the titanium which is a common practice in the welding of titanium, but in this case, $TiB_2$ and Ti were fed to the melted surface of the substrate plate to produce the continuously graded Ti/$TiB_2$ microstructure.

Example 3

Example 1 was repeated except only $TiB_2$ particles were fed to the molten pool on the titanium alloy substrate without any codeposition of titanium powder. The average $TiB_2$ content in the cermet layer was approximately 80% (vol) but can be controlled to virtually any level via the power input to the torch, the torch rate of movement across the substrate generating the molten pool, and the feed rate of the $TiB_2$ particulate.

Example 4

A commercial plate of Ti-6-4 was used as the substrate to deposit a Ti/$B_4C$ cermet layer using a plasma transferred arc welding torch in an inert gas chamber. The deposit was made in a single pass. The average $B_4C$ content in the cermet layer was ~70% (vol). The maximum concentration was at the front or strike face, and the lowest concentration was in the region of the original Ti-6-4 substrate used for the deposition. The $B_4C$ has a density ~55% of that of $TiB_2$ as well as being more economical than $TiB_2$, resulting in a lower areal density (that is weight) of an armor component.

Example 5

A commercial plate of high hardness armor grade steel with a thickness of 0.1875" was used as the substrate to deposit a steel/$TiB_2$ cermet layer using a plasma transferred arc welding torch in an inert gas chamber. The deposit was made in a single pass. The average $TiB_2$ content in the cermet layer was ~70% (vol). The maximum concentration was at the front or strike face, and the lowest concentration was in the region of the original steel substrate used for the deposition. The application of the $TiB_2$ into the steel reduced its areal density by approximately 15% which can be a major weight saving for an entire vehicle armored with a steel cermet system as well as enhanced ballistic performance.

Example 6

Example 5 was repeated using $B_4C$ powder in place of the $TiB_2$ powder. The average $B_4C$ content in the cermet layer was 70% (vol). The maximum concentration was at the front or strike face, and the lowest concentration was in the region of the original steel substrate used for the deposition. The application of the $B_4C$ into the steel reduced its areal density by approximately 20% which can be a major weight saving for an entire vehicle armored with a steel cermet system as well as enhanced ballistic performance.

Example 7

Figure 6:
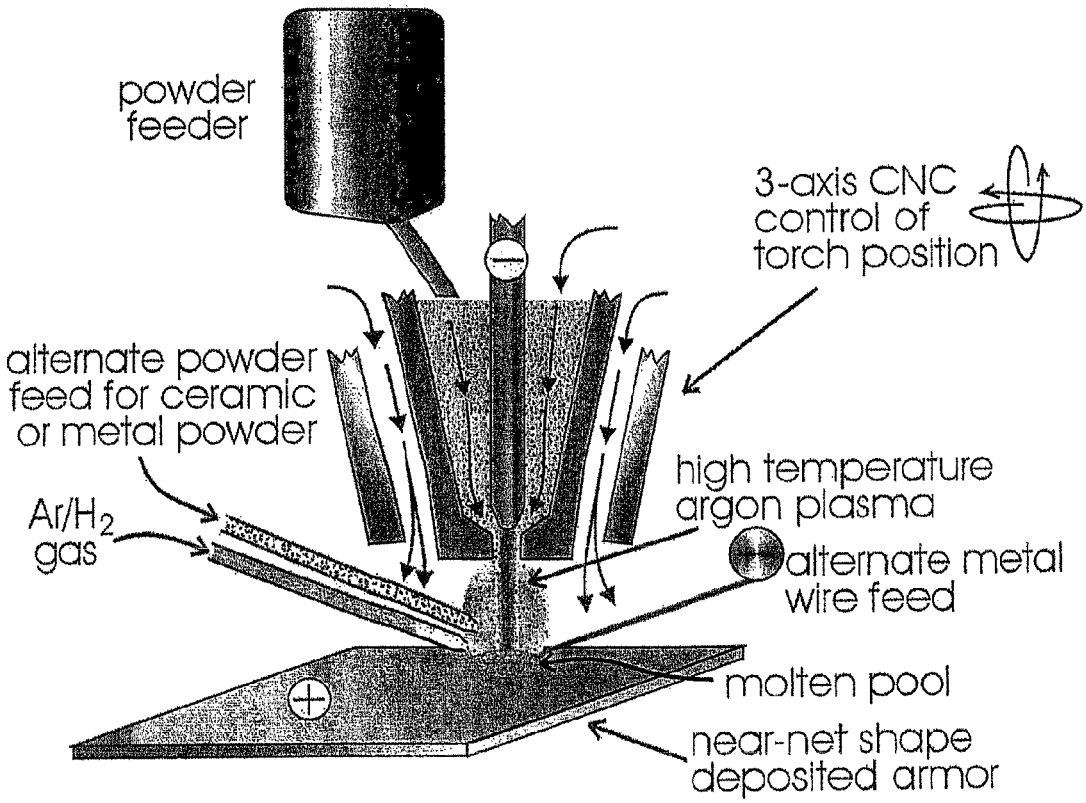
FIG. 6 is a schematic of the apparatus shown in FIG. 1 modified for the introduction of $H_2$ gas to the melt pool.

Example 4 was repeated except that a mixture of 5% $H_2$/95% Ar was introduced in the region of the melt pool using the modified apparatus as illustrated in FIG. 6. A reduction of the surface roughness on the strike face was observed.

Example 8

A Ti/$TiB_2$ tile was made by the same process as described in Example 3. A thin top layer with a $TiB_2$ content >90% (vol) was deposited onto the cermet surface using the plasma transferred arc welding torch. The higher ceramic or $TiB_2$ content on the surface enhances the ballistic performance by turning, tumbling, or fracturing the incoming projectile.

Example 9

Figure 7:
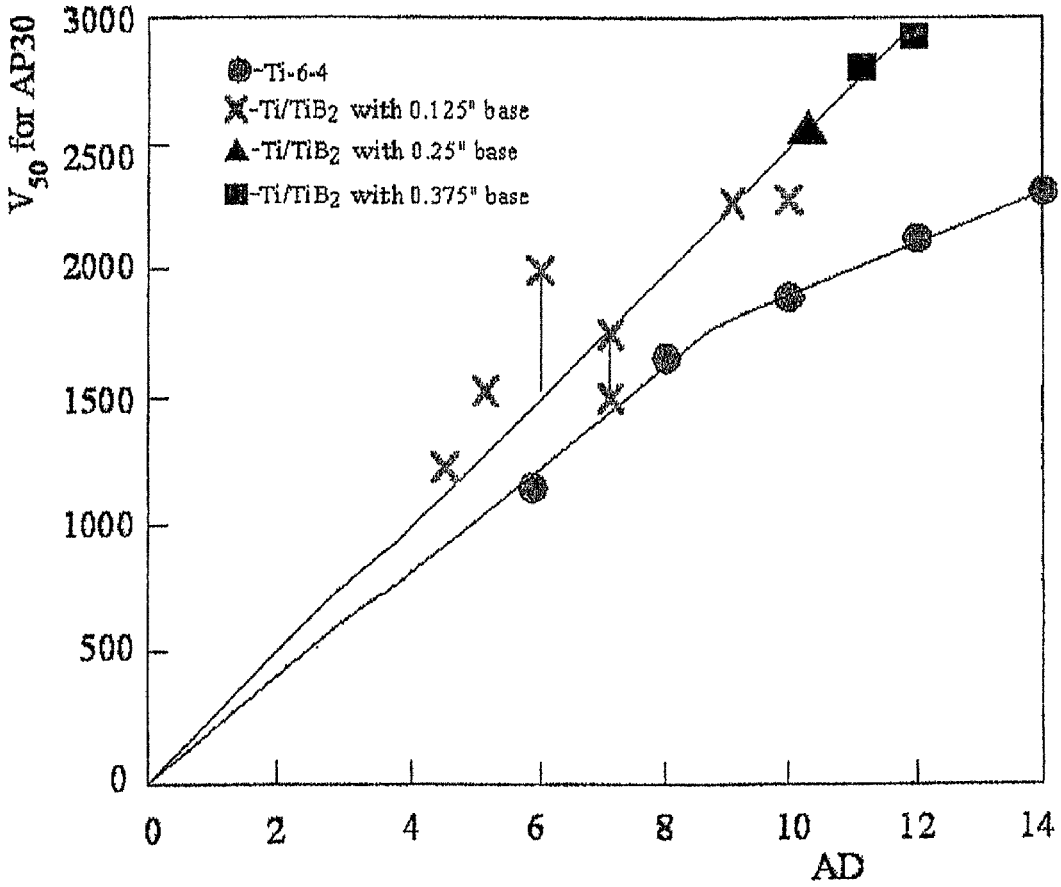
FIG. 7 is a summary of $V_{50}$ test results for ballistic testing with an AP30 threat comparing the performance of Ti-6-4 to a graded $TiB_2$/Ti-6-4 cermet composite armor.

Several Ti/$TiB_2$ armor tiles were made by the process described in Example 1. The tiles were made with an areal density ranging from about 4 lb/ft$^2$ to about 12 lb/ft$^2$. These tiles were then used for ballistic testing to determine V50 against an AP30 threat. Several tiles of Ti-6-4 (no ceramic content) with an areal density ranging from about 6 lb/ft$^2$ to about 14 lb/ft$^2$. were then tested in the same manner. The results shown in FIG. 7 illustrate the substantial reduction in areal density required for the Ti/$TiB_2$ armor relative to the Ti-6-4 armor to defeat an AP30 threat of a given velocity. The performance advantage of the Ti/$TiB_2$ armor relative to Ti-6-4 increases at higher areal densities.

Example 10

Example 1 was repeated except that metallic boron powder was added to the feed material in addition to $TiB_2$ and Ti powders. In addition to the added $TiB_2$, the cermet contains titanium borides generated as a reaction product during the deposition.

It should be understood that the preceding is merely a detailed description of one embodiment of this invention and that numerous changes to the disclosed embodiment can be made in accordance with the disclosure herein without departing from the spirit or scope of the invention.

We claim:

1. A cermet armor material for highly effective ballistic performance which is comprised of a layer of base metal into which is deposited a layer or layers of ceramic particles and compatible metal such that the deposited metal in combination with the base metal forms a continuous matrix around the ceramic particles, said armor material having a strike face and a structure which is continuously graded from a highest ceramic content at the strike face decreasing to zero within the base metal, and containing no abrupt interfaces, wherein the contents of each layer is at least partially intermixed with the contents of the preceding layer, wherein said armor material has substantially no porosity, wherein the base metal is a titanium alloy, and the ceramic particles comprise titanium boride.

2. The cermet armor of claim 1, containing an additional layer at the strike face with a ceramic content greater than about 50% (vol), and which is functionally graded to a previously deposited cermet layer of reduced ceramic content with no abrupt interface.

3. The cermet armor of claim 1, wherein the base metal is Ti-6-4.

4. The cermet armor of claim 1, wherein the ceramic content of the deposited layer is at least about 50% (vol).

5. The cermet armor of claim 1, wherein the ceramic content of the deposited layer is at least about 60% (vol).

6. The cermet armor of claim 1, wherein the ceramic content of the deposited layer is at least about 70% (vol).

7. The cermet armor of claim 1, wherein the ceramic content of the deposited layer is at least about 80% (vol).

8. The process to make the cermet armor of claim 1, wherein a high energy beam is used to melt a metal feed and deposit a mixture of the metal feed with a ceramic powder feed on a base metal substrate of a composition compatible with the metal feed.

9. The process of claim 8, wherein the power level used for the high energy beam is sufficient to melt the base metal substrate and any intermediate layers so as to form a continuously graded structure of injected ceramic powder.

10. The process of claim 8, wherein the high energy source is selected from the group consisting of a plasma transferred arc welding torch, a tungsten inert gas welding torch, a metal inert gas welding torch, an E-beam welding torch and a laser.

11. The process of claim 8, wherein the power level used for the high energy beam is sufficient to melt the base metal substrate and any intermediate layers so as to form a continuously graded structure with the injected material.

12. The process to make the cermet armor of claim 1, wherein a high energy beam is used to melt a base metal substrate with concurrent injection of ceramic powder into the molten surface of the base metal substrate.

13. The process to make the cermet armor of claim 1, wherein a high energy beam is used to deposit a base metal substrate by the solid free form fabrication process, and the cermet layer is subsequently built up by melting a metal feed of a metal which is compatible with the deposited substrate and injecting a ceramic powder into the molten surface of the deposited structure.

14. The process to make the cermet armor of claim 1, wherein a high energy beam is used to deposit a base metal substrate by the solid free form fabrication process, and the cermet layer is concurrently built up by melting a metal feed of a metal which is compatible with the deposited substrate and injecting a ceramic powder into the molten surface of the deposited structure.

15. The process of claim 1, wherein the cermet contains titanium borides generated as a reaction product during the deposition.

16. A cermet armor material for highly effective ballistic performance which is comprised of a layer of base metal into which is deposited a layer or layers of ceramic and a metal which is compatible with the base metal such that the metal in combination with the base metal forms a continuous matrix around the ceramic particles, said deposition being accomplished by melt deposition of the metal matrix composite using a high energy beam, the armor material having a strike face and a structure which is continuously graded from a highest ceramic content at the strike face decreasing to zero within the base metal, and containing no abrupt interfaces, wherein the contents of each layer is at least partially intermixed with the contents of the preceding layer wherein said armor material has substantially no porosity, wherein the base metal comprises a titanium alloy and the ceramic comprises titanium boride.

17. The cermet armor material of claim 16, containing an additional layer at the strike face with a ceramic content greater than about 80% (vol), and which is functionally graded to the adjacent cermet layer of reduced ceramic content with no abrupt interface.

* * * * *